United States Patent [19]

Kotani et al.

[11] Patent Number: 4,728,779

[45] Date of Patent: Mar. 1, 1988

[54] PTC HEATING DEVICE

[75] Inventors: Sho Kotani; Michikazu Takeuchi; Sumihiro Yasuda, all of Tokyo; Kengo Ogawa, Hiroshima, all of Japan

[73] Assignees: TDK Corporation; Fumakilla Limited, both of Tokyo, Japan

[21] Appl. No.: 910,415

[22] Filed: Sep. 22, 1986

[30] Foreign Application Priority Data

| | | | |
|---|---|---|---|
| Sep. 27, 1985 | [JP] | Japan | 60-147593[U] |
| Sep. 27, 1985 | [JP] | Japan | 60-147595[U] |
| Oct. 29, 1985 | [JP] | Japan | 60-166345[U] |
| Dec. 27, 1985 | [JP] | Japan | 60-200380[U] |
| Dec. 27, 1985 | [JP] | Japan | 60-200381[U] |

[51] Int. Cl.[4] ..... H05B 1/02

[52] U.S. Cl. ..... 219/517; 219/505; 219/530; 219/540; 338/22 R; 361/104

[58] Field of Search ..... 219/275, 504, 505, 506, 219/517, 530, 536, 537, 540, 541, 544; 338/22 R, 328; 337/102; 361/104; 340/638, 639

[56] References Cited

U.S. PATENT DOCUMENTS

| | | | |
|---|---|---|---|
| 3,685,049 | 8/1972 | Immel et al. | 340/638 X |
| 3,976,854 | 8/1976 | Ishikawa et al. | 219/540 X |
| 4,341,949 | 7/1982 | Steiner et al. | 219/540 X |

*Primary Examiner*—Patrick R. Salce
*Assistant Examiner*—Emanuel Todd Yoeltz

[57] ABSTRACT

A PTC heating device which is widely applicable as a heating source to a variety of electronic apparatuses such as an electronic mosquito destroyer an electronic jar and the like. The PTC heating device includes a porcelain casing in which an electrode structure comprising a PTC thermistor having electrodes arranged on both surfaces thereof and two electrode plates interposing the thermistor therebetween is received in a manner such that terminals of the electrode plates is downwardly led out through the porcelain casing. The PTC heating device also includes a heat radiating plate arranged through an insulating plate on the electrode structure and provided at flanges thereof with a plurality of holding pawls which are located at positions apart from the terminals of the electrode plates on a bottom surface of the porcelain casing to securely hold the heat radiating plate and the porcelain casing together and ensure an adequate insulating distance between the holding pawls and the terminals. The electrode plate arranged on the PTC thermistor is provided with a narrow section which is adapted to be fused due to an overcurrent flowing therethrough. The PTC heating device also includes various mechanisms in relation to such an overcurrent fusion function.

9 Claims, 13 Drawing Figures

PTC HEATING DEVICE

BACKGROUND OF THE INVENTION

1. Field of the Invention

This invention relates to a positive temperature coefficient (hereinafter referred to as "PTC") heating device, and more particularly to a PTC heating device which is adapted to be widely used as a heating source for various kinds of electronic appliances such as an electronic mosquito destroyer, an electronic jar and the like.

2. Description of the Prior Art

As an example of an electronic appliance having a PTC heating device incorporated therein, an electronic mosquito destroyer will be referred to in the following. In an electronic mosquito destroyer, a head radiating plate on which a repellent-impregnated mat is placed is arranged in a resinous armoring case so as to be exposed at a part thereof on an opened upper surface of the armoring case, in which armoring case an electrode structure including a PTC thermistor or the like is received in a manner to be integral with the heat radiating plate and electrode plates are arranged to interpose the PTC thermistor therebetween, while a power cord or attachment plug is connected to terminals of the electrode plates.

In the conventional electronic mosquito destroyer described above, a PTC heating device is generally constructed as shown in FIGS. 1 to 3. The conventional PTC heating device for the electronic mosquito destroyer of FIGS. 1 to 3 includes a porcelain casing 4 having a recess 40, a PTC thermistor 3 being vertically interposed between electrode plates 1 and 2 and received in the recess 40 of the casing 4, and a heat radiating plate 6 being arranged on a recess formed surface of the porcelain casing 4 in a manner to be positioned on the electrode plate 1 through an insulating plate 5. The heat radiating plate 6 is provided at flanges thereof with a plurality of holding pawls 60–63 which extend downwardly therefrom and are adapted to be bent inwardly on a bottom surface of the porcelain casing 4 to hold the casing 4 together to integrally assemble the PTC heating device. Also, in the conventional PTC heating device, terminals 10 and 20 are integrally formed at the electrode plates 1 and 2 which contact with electrodes 30 and 31 of the PTC thermistor 3, respectively, and the terminals 10 and 20 are projected downwardly through the porcelain casing 4 and connected to a power cord or attachment plug. More particularly, such downward projecting of the terminals 10 and 20 through the porcelain casing 4, as shown in FIG. 3, is carried out in a manner such that the terminals 10 and 20 are extended downwardly via through-holes which are formed at a central region of the porcelain casing 4 so as to be opposite to and spaced from each other and the holding pawls 60, 62 and 61, 63 are bent inwardly to be engaged with the bottom surface of the porcelain casing 4 at positions aligned with the terminals 10 and 20, respectively.

However, such a conventional construction of projecting the terminals outwardly of casing 4 fails to ensure a sufficient insulating distance between the terminals 10, 20 serving as conductive means and the heat radiating plate 6 which human fingers contact. Also, such a PTC heating device is generally required to exhibit a sufficient voltage-withstanding property because voltage ratings, from a safety standards point of view, generally vary from country to country; e.g. 100 v, 125 v or 220 v. However, the conventional heating device above described, because the terminals 10 and 20 of the electrode plates 1 and 2 are proximate to the holding pawls 60–63 of the heat radiating plate 6, it fails to provide a satisfactory voltage-withstanding property. Further, the connection of the power cord or attachment plug to the terminals 10 and 20 opposite to each other is conventionally carried out by spot-welding; however, the welding operation is highly troublesome and difficult because when the power cord or attachment plug is to be connected to the inside of one of the terminals, a welding rod is touched by the other terminal, so that the other terminal hinders the welding operation.

Also, in the conventional PTC heating device, when the PTC thermistor deteriorates, excess current will flow through the PTC thermistor, at thermal equilibrium, to cause damage or abnormal heating of the PTC thermistor, resulting in a fire or the like. In order to avoid such a defect, one of the electrode plates, for example the upper electrode plate 1, is formed with a narrow section 11 which is adapted to be fushed when an overcurrent flows therethrough. The narrow section 11, as shown in FIG. 1, is conventionally formed to be flush with a contact section 12 of the electrode plate 1, which is contacted with the electrode 30 of the PTC thermistor 3, and is interposed between the contact section 12 and the terminal 10.

However, since the narrow section 11 is formed flush with the contact section 12 of the electrode plate 1 as described above, the entire narrow section 11 is contacted with the insulating plate 5 which is superposed on the electrode plate 1 as shown in FIG. 2. In consequence heat which is generated at the narrow section 11 due to the flow of an overcurrent through the narrow section 11 will be radiated through the insulating plate 5, thereby requiring substantial time for the narrow section 11 to fuse.

SUMMARY OF THE INVENTION

The present invention has been made with a view to overcoming the foregoing problems of the prior art device.

It is therefore an object of the present invention to provide a PTC heating device which is capable of positioning terminals of electrode plates and holding pawls of a heat radiating plate in a manner to be spaced from each other on a bottom surface of a porcelain casing at a distance sufficient to cause the device to exhibit satisfactory voltage-withstanding property.

It is another object of the present invention to provide a PTC heating device, wherein a narrow section of an electrode plate serving as a fusion section may be fused in a short time when an overcurrent flows through the narrow section.

It is still another object of the present invention to provide a PTC heating device which is provided with various mechanical means in relation to the provision of an overcurrent fusion section at an electrode plate.

In accordance with the present invention, a PTC heating device is provided. The PTC heating device includes an electrode structure comprising a PTC thermistor having upper and lower electrodes arranged on upper and lower surfaces thereof and a pair of upper and lower electrode plates arranged to vertically interpose the PTC thermistor therebetween, and a porcelain casing provided with a first recess for receiving the electrode structure therein. The upper and lower electrode plates are respectively provided with terminals which are positioned so as to be spaced from each other and downwardly led out through the porcelain casing. The terminals are staggered along a transverse central line of the porcelain casing so as to be separated from each other. The PTC heating device also includes an insulating plate placed on a first recess formed surface of the porcelain casing in a manner to be arranged on the upper electrode plate and a heat radiating plate arranged on the insulating plate in a manner to cover the porcelain casing. The heat radiating plate is provided at flanges thereof with a plurality of holding pawls which are bent on a bottom surface of the porcelain casing for securely mounting the heat radiating plate with respect to the porcelain casing therethrough. The holding pawls are located at positions apart from the terminals of the upper and lower electrode plates extending downwardly from the porcelain casing.

The inventive features are defined in the claims following the disclosure which in turn follows the description of the drawings.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a PTC heating device according to the present invention will be described hereinafter with reference to FIGS. 4 to 13.

FIGS. 4 to 10 illustrate a PTC heating device according to a first embodiment of the present invention. A PTC heating device of the illustrated embodiment is adapted to be used for an electronic mosquito destroyer.

Figure 1:
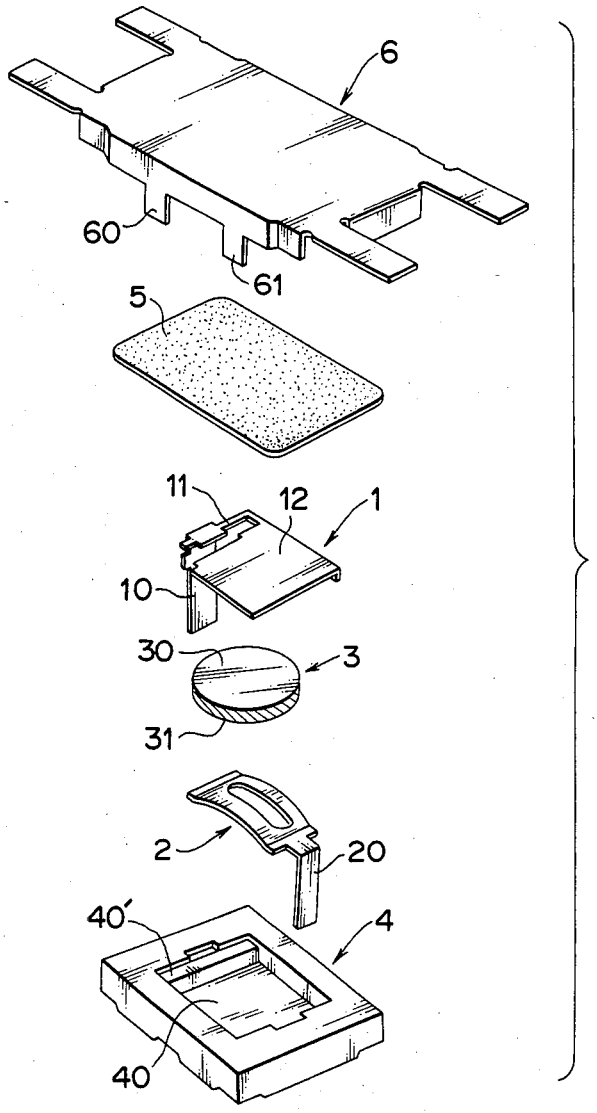
PRIOR ART FIG. 1
FIG. 1 is an exploded perspective view showing a conventional PTC heating device.
Figure 2:
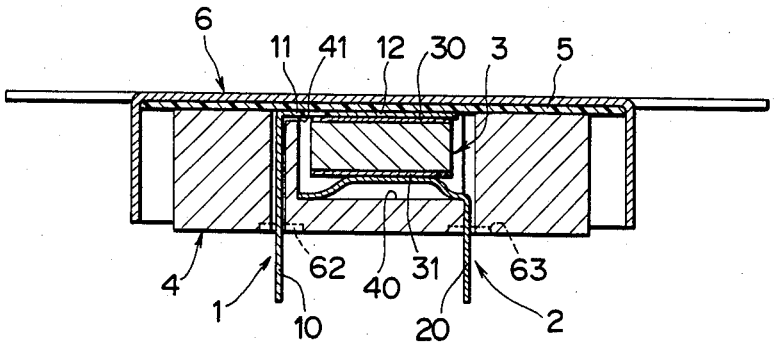
PRIOR ART FIG.2
FIG. 2 is a sectional view of the conventional PTC heating device into which parts thereof shown in FIG. 1 are assembled.
Figure 3:
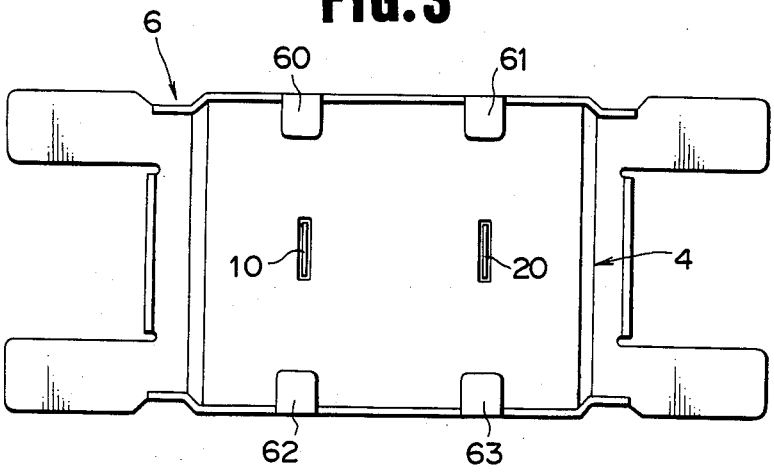
PRIOR ART FIG.3
FIG. 3 is a bottom view of the conventional PTC heating device into which the parts thereof shown in FIG. 1 are assembled.
Figure 4:
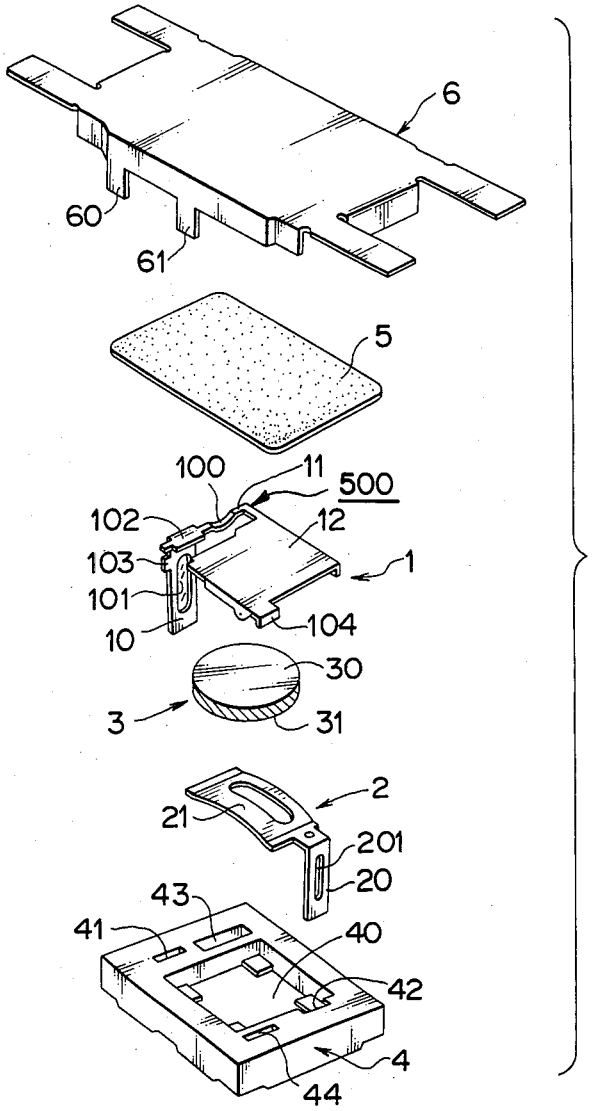
FIG. 4 is an exploded perspective view of a PTC heating device according to a first embodiment of the present invention.
Figure 5:
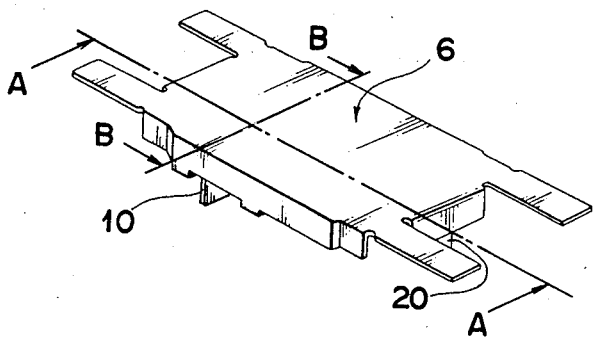
FIG. 5 is a schematic perspective view of the PTC heating device according to the first embodiment, into which parts thereof shown in FIG. 4 are assembled.
Figure 6:
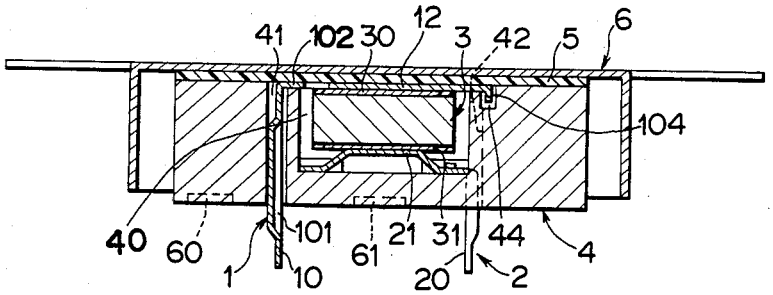
FIG. 6 is an enlarged vertical sectional view of the PTC heating device according to the first embodiment, taken on a plane indicated at FIG. 5 by a line A—A.
Figure 7:
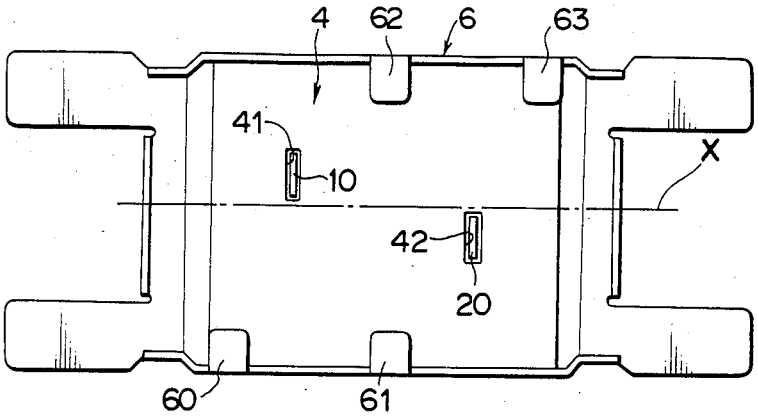
FIG. 7 is a bottom view of the PTC heating device according to the first embodiment.

The PTC heating device of the illustrated embodiment includes a PTC thermistor 3 which, as shown in FIG. 4, is formed into a disc-like shape and has upper and lower electrodes 30 and 31 provided on upper and lower surfaces thereof, respectively. The PTC heating device also includes upper and lower electrode plates 1 and 2 formed of a conductive material such as stainless steel or the like and arranged to vertically interpose the PTC thermistor 3 therebetween as shown in FIG. 6. An electrode structure comprising the electrode plates 1 and 2 and PTC thermistor 3 assembled as described above is received in a first recess 40 formed in a porcelain casing 4 formed of a heat-resistant insulating material such as alumina or the like. In the illustrated embodiment, the upper electrode plate 1 is provided with a terminal 10, which is integrally formed at one side end thereof to extend downwardly therefrom; whereas the lower electrode plate 2 is provided with a terminal 20 which is integrally formed to extend downwardly therefrom and arranged at a position opposite to and spaced from the terminal 10. Correspondingly, the porcelain casing 4 is formed with a pair of through-holes 41 and 42 which are offset relative to a transverse central line (indicated by dash and dot line X in FIG. 7) of the porcelain casing 4 so as to be spaced from each other and out of alignment with the central line, contrary to the prior art showing of FIG. 3. Thus, when the electrode plates 1 and 2 are received in the porcelain casing 4 together with the PTC thermistor 3, the terminals 10 and 20 are projected downwardly via the through-holes 41 and 42 from the porcelain casing 4 in the manner described, that is, offset relative to the transverse central line X and spaced from each other a suitable distance, as shown in FIG. 7.

The PTC heating device of the illustrated embodiment also includes an insulating plate 5 which is formed of a suitable insulating material such as mica or the like and positioned above the upper electrode plate 1 and a heat radiating plate 6 which is formed of a material having a satisfactory thermal conductivity such as stainless steel and arranged above the insulating plate 5 in a manner to cover the porcelain casing 4. The heat radiating plate 6 is provided at each of its sides with flanges each having a pair of holding pawls 60, 61 and 62, 63 (see FIG. 7) integrally formed so as to extend downwardly therefrom. The holding pawls 60–63 are each adapted to be bent inwardly on a bottom surface of the porcelain casing 4, to thereby securely hold the heat radiating plate 6 with respect to the porcelain casing 4 through the pawls 60–63, when the plate 6 is positioned with respect to the casing 4. Also, the holding pawls are formed so as to be positioned, spaced from the terminals 10 and 20, at distances sufficient to provide adequate insulation between the pawls and the terminals when the plate 6 is secured to the casing 4. For this purpose, as shown in FIG. 7, the pawls 61 and 62 are arranged at middle positions of the flange to lie between the terminals 10 and 20 while pawls 60 and 63 are provided at opposite corners of the flanges most distant from terminals 10 and 20.

The PTC heating device of the illustrated embodiment constructed as described above may be received in upper and lower armoring cases (not shown), which are adapted to be fitted into each other, in a manner such that the heat radiating plate 6 may be exposed at a central portion thereof from the upper armoring case. In this instance, a power cord is led out from the armoring case or an attachment plug is mounted on the armoring case, which power cord or attachment plug may then be connected to an inside of each of the terminals 10 and 20, projecting downwardly from the porcelain casing 4, by spot welding. Such connection is made by welding electric wires of the power cord or attachment plug to the terminals 10 and 20. The PTC heating device of the illustrated embodiment facilitates the connection operation because the terminals 10 and 20 are offset and spaced from each other as described a distance sufficient to facilitate the welding operation by avoiding hindrance of one of the terminals against a welding operation on the other terminal when using a welding rod. The illustrated embodiment thus permits bending of the holding pawls 60–63 of the heat radiating plate 6 at positions sufficiently distant from the terminals 10 and 20 such as 8 mm. or more, so that adequate electrical insulation may be provided between the heat radiating plate 6 and the terminals 10 and 20. Such arrangement also allows adequate creeping between the plate 6 and the terminals. Thus, the illustrated embodiment exhibits excellent insulating and voltage-withstanding properties sufficient for operation at voltages prevalent in different countries, such as 100 v, 125 v or 220 v.

The upper and lower electrode plates 1 and 2 include engage sections 12 and 21 which contact with the upper and lower electrodes 30 and 31 of the PTC thermistor 3, respectively. In the illustrated embodiment, the contact section 21 of the lower electrode plate 2 positioned under the PTC thermistor 3 is curved upwardly to exhibit elasticity, so that the holding of the porcelain casing 4 by means of the holding pawls 60–63 of the heat radiating plate 6 may be carried out while tightly contacting the electrodes 30 and 31 of the PTC thermistor 3 with the contact sections 12 and 21. Contact section 12 has a substantially inverted L-shaped portion 500 (best seen in FIGS. 4, 8 and 11) which extends at one end thereof from one side of contact section 12. Portion 500 includes a narrow section which interconnects the terminal 10 and the contact plate section 12 and acts as an excessive current fusion section. In the illustrated embodiment, the narrow section 11 has a concavely curved downwardly curved portion, illustrated in FIGS. 3 and 8 as a substantially middle portion 100, so as to be spaced from the insulating plate 5 positioned thereon, as shown in FIG. 9. The downwardly curved portion 100 of the narrow section 11 is adapted to be received in a second recess 43 formed at an upper surface portion of the porcelain casing 4, proximate the end of one side of the casing 4, for maintaining a spacing between the PTC thermistor 3 and the insulating plate when the PTC heating device of the illustrated embodiment is in use. Such construction significantly shortens the time required for the narrow section 11 to be fused, because the curved portion 100 is spaced from the insulating plate 5, thereby decreasing heat radiation from the narrow section 11 to the insulating plate 5. In the illustrated embodiment, the upper electrode plate 1 is formed by punching a stainless steel sheet such as an SUS 304 sheet having a thickness of, for example, about 0.1 mm. determined by the required thickness of the narrow section 11, to form a sheet of a predetermined pattern, whereafter the required bending or plastic working of the thus punched sheet is carried out so that the contact section 12, terminal 10 and narrow section 11 may have substantially the same thickness. Further, in the illustrated embodiment, the narrow section 11 has a width of about 0.28 mm. and the curved portion 100 is curved downwardly about 0.3 mm. away from the upper surface of the narrow section 11.

Figure 10:
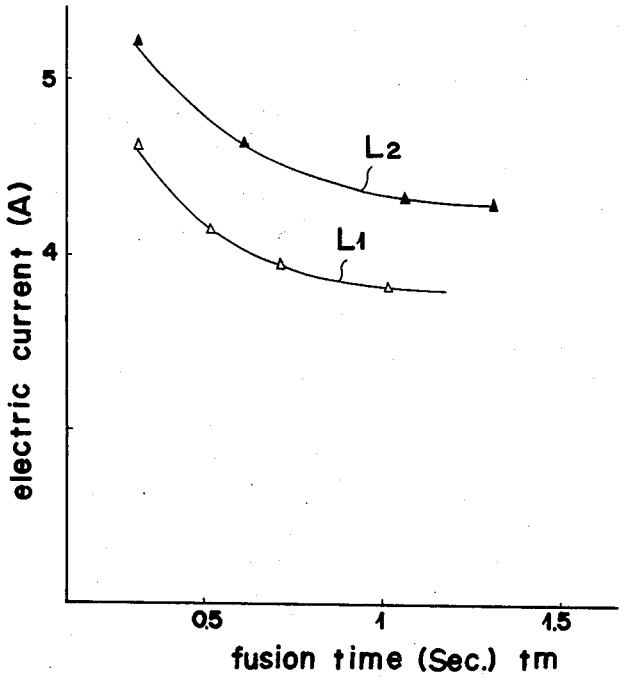
FIG. 10 shows the relationship between current and fusing time of a narrow section. Comparing the PTC heating device according to the first embodiment with the conventional PTC heating device.

FIG. 10 shows the relationship between current and time required for the narrow section 11 to be fused due to the flow of an overcurrent, comparing with the PTC heating device of the present invention constructed as described above, with the conventional PTC heating device, wherein reference characters L1 and L2 respectively designate a curved line showing the relationship between current and fusing time in the PTC heating device of the present invention and the relationship between current and fusing time in the conventional PTC heating device. It will readily be understood from FIG. 10 that, under the same current intensity, the fusing time tm in the PTC heating device according to the present invention is shorter than that in the conventional PTC heating device. Now, supposing that a current of, for example, 4.6 amps flows through the narrow section, the fusing time tm of the narrow section in the conventional PTC heating device is about 0.6 seconds, while the fusing time tm of the narrow section in the PTC heating device according to the present invention is about 0.3 seconds, and therefore, may be shortened by about half of the fusing time in the conventional PTC heating device. Further, at the same fusing time tm, current intensity required for the narrow section to be fused in the PTC heating device according to the present invention is decreased by about 0.6 amps as compared with that in the conventional PTC heating device. Furthermore, it will readily be understood from FIG. 10 that the range of variation of the fusing time tm in relation to variation of the fusing current intensity in the PTC heating device according to the present invention is narrower than that in the conventional PTC heating device.

Figure 8:
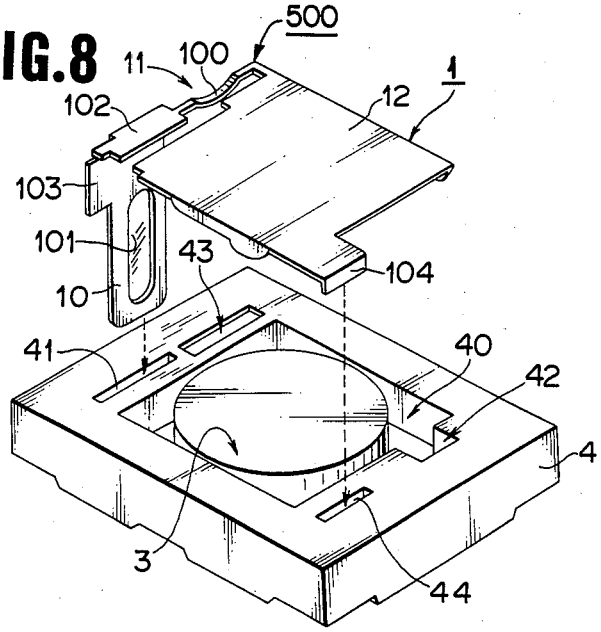
FIG. 8 is a schematic enlarged perspective view of the PTC heating device according to the first embodiment, wherein an insulating plate and a heat radiating plate are removed and an upper electrode plate is separated from a porcelain casing for clarity of illustration.
Figure 9:
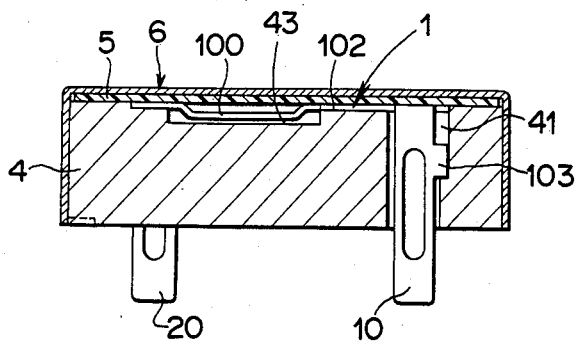
FIG. 9 is an enlarged vertical sectional view of the PTC heating device according to the first embodiment, taken on a plane indicated in FIG. 5 by a line B—B.

Further, in the illustrated embodiment, the upper electrode plate 1, as shown in FIGS. 4 and 8, is provided with a first reinforcement means 101 which is concavely formed by outwardly expanding a substantially middle portion of the terminal 10. The reinforcement means 101 may be formed by, for example, press working. The illustrated embodiment constructed in this manner provides the terminal 10 with satisfactory mechanical strength by means of the embossed reinforcement means 101 while allowing the narrow section 11 to have a small width suitable for overcurrent fusion.

As shown in FIG. 4, the terminal 20 of the lower electrode plate 2 may be likewise provided with a similar reinforcement means 201 to permit the terminal to exhibit good mechanical strength therethrough.

In addition, the PTC heating device of the illustrated embodiment, as shown in FIGS. 4 and 8, may be constructed in such a manner that the terminal 10 is formed at an upper portion thereof with a second reinforcement means which serves to prevent external force applied to the terminal 10 during assembly of the PTC heating device from being transmitted to the narrow section 11. Such construction effectively prevents the narrow section 11 of less mechanical strength from being damaged by such external force. In the illustrated embodiment, the second reinforcement means comprises a horizontal reinforcement member 102 formed of a conductive material and connected at one end thereof to the narrow section 11 and a vertical reinforcement member 103 formed of a conductive material and connected between the horizontal member 102 and the terminal 10. As shown in FIG. 9, the horizontal reinforcement member 102 is adapted to be interposed between an upper flat surface of the porcelain casing 4 and the insulating plate 5 and the vertical reinforcement member 103 is engagedly fitted in the throught-hole 41 formed at the casing 4. The members 102 and 103 are each conveniently made of the same material as the electrode plate.

Further, in the PTC heating device of the illustrated embodiment, as shown in FIGS. 4 and 8, the upper electrode plate 1 is provided on an outer periphery thereof opposite to the terminal 10 with a downwardly bent portion 104. The downwardly bent portion 104 of the electrode plate 1 is positioned in a third recess 44 formed at the upper surface of the porcelain casing 4, to thereby prevent the contact section 12 of the upper electrode plate 1 from being moved on the PTC thermistor 3 when the narrow section 11 of the upper electrode plate 1 is fused due to the flow of an overcurrent therethrough to separate the contact section 12 from the terminal 10. Thus, such construction effectively prevents the contact section 12 from electrically contacting with a fused end portion of the terminal 10 after the fusion of the narrow section 11.

Figure 11:
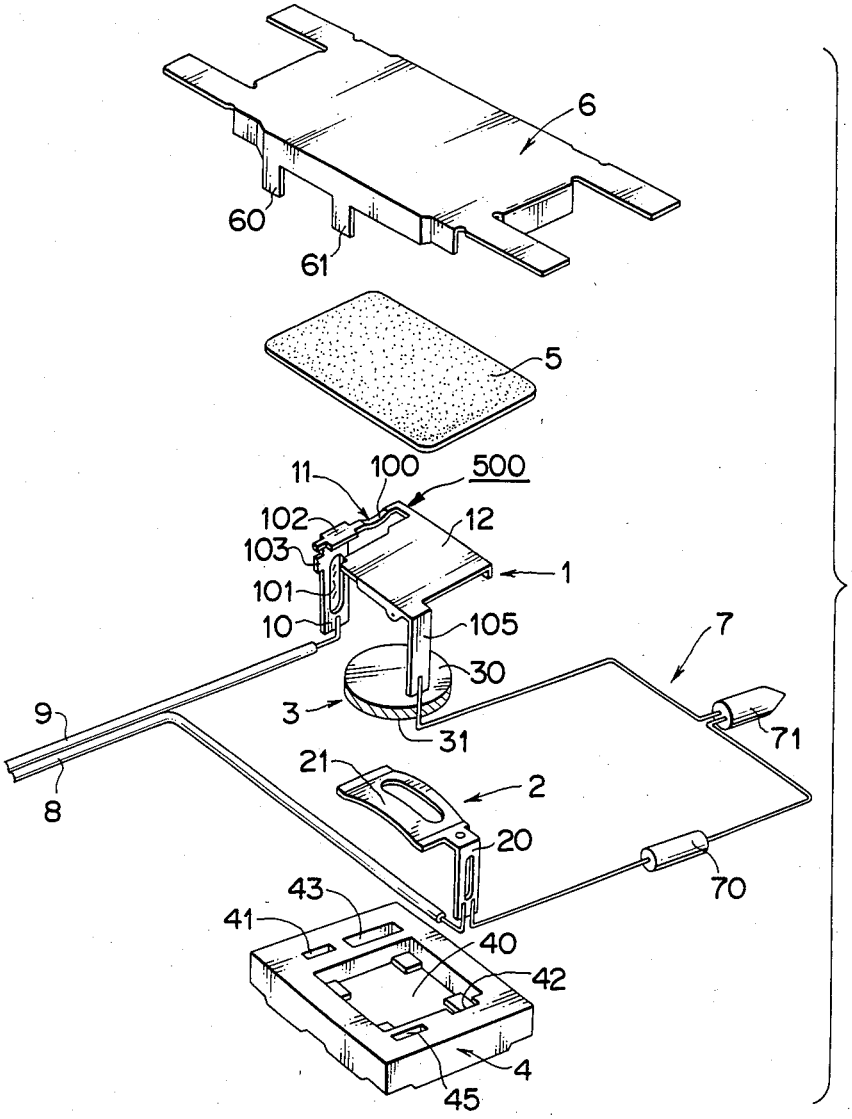
FIG. 11 is an exploded perspective view of a PTC heating device according to a second embodiment of the present invention.
Figure 12:
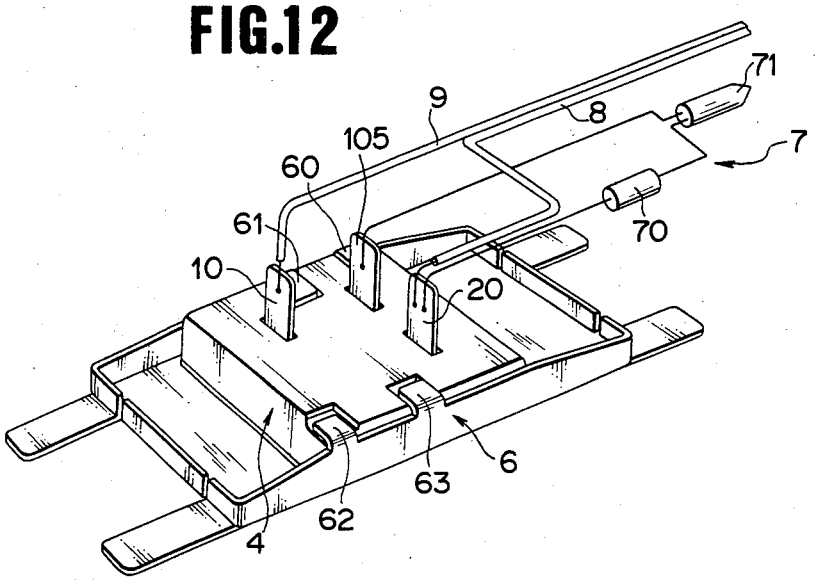
FIG. 12 is a schematic enlarged perspective view showing a bottom surface of the PTC heating device according to the second embodiment, into which parts thereof shown in FIG. 11 are assembled.

FIGS. 11 and 12 illustrate a PTC heating device according to a second embodiment of the present invention. A PTC heating device of the illustrated embodiment includes an overcurrent fusion detecting circuit 7 for detecting fusion of a narrow section 11 of an upper electrode plate 1 due to an overcurrent, which detecting circuit 7 is connected between the upper electrode plate 1 and a lower electrode plate 2 through a lead-out terminal of the upper electrode plate 1 and a terminal of the lower electrode plate 2, as described later. The upper electrode plate 1 is provided at a periphery portion of a contact section 12 thereof with a lead-out terminal 105 independent from a terminal 10, which terminal 105 is downwardly led out via a through-hole 45, which is formed at a porcelain casing 4, to an exterior of the casing 4. The above-described overcurrent fusion detecting circuit 7 is connected between the lead-out terminal 105 and a terminal 20 of the lower electrode plate 2. In the illustrated embodiment, the detecting circuit 7 is in the form of a lamp circuit comprising a resistor 70 and a neon lamp 71. The connection of the detecting circuit 7 to the lead-out terminal 105 and terminal 20 is desirably carried out using a suitable method which provides the connection with high reliability and a good heat-resistant property, such as spot welding or the like.

Reference numeral 8 designates a lead wire which is connected to the terminal 20 of the electrode plate 2 by spot welding or the like and has a heat-resistant insulating coating applied thereon and reference numeral 9 indicates a lead wire similar to the lead wire 8, which lead wire 9 is connected to the terminal 10 of the electrode plate 1 by spot welding.

The remaining part of the PTC heating device shown in FIGS. 11 and 12 may be constructed in substantially the same manner as that shown in FIGS. 4 to 10.

Figure 13:
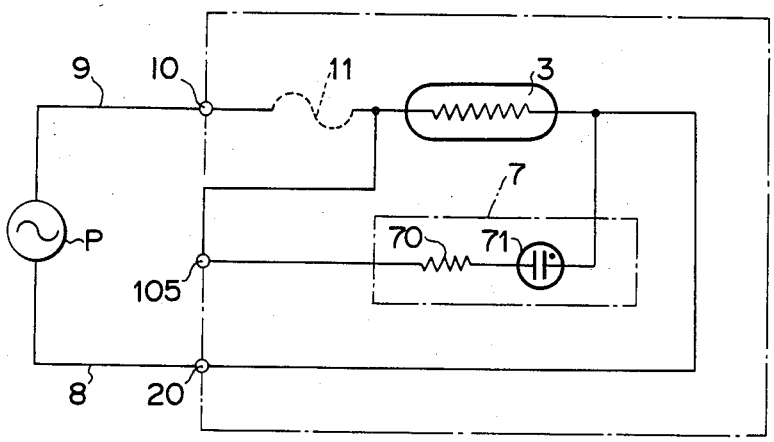
FIG. 13 is a circuit diagram showing an electric circuit of the PTC heating device according to the second embodiment.

The PTC heating device shown in FIGS. 11 and 12 may have such an electric circuit as shown in FIG. 13. The circuit of FIG. 13 is constructed in a manner to apply a voltage of a power supply P to a PTC thermistor 3 through the narrow section 11 acting as an overcurrent fusion section on the side of the upper electrode plate 1 and, on the side of the lower electrode plate 2, thereby applying the voltage of the power supply P access the PTC thermistor 3 and connecting the overcurrent fusion detecting circuit 7 between terminals of the PTC thermistor 3 as shown in FIGS. 11 and 13. Accordingly, the voltage applied to the PTC thermistor 3 is also applied to the overcurrent fusion detecting circuit 7 to light the neon lamp 71 when the narrow section 11 is intact. On the other hand, when the narrow section 11 is fused due to the flow of an overcurrent therethrough, the voltage of the power supply will not be applied to the PTC thermistor 3 nor to the overcurrent fusion detecting circuit 7 resulting in the extinguishing of the light from the neon lamp 71. Thus, the overcurrent fusion of the narrow section is detected due to the inoperation of the neon lamp 71. Further, the illustrated embodiment, as described above, is so constructed that the lead-out terminal 105 is provided at the contact section 12 of the electrode plate 1 and downwardly led out via the through-hole 45 of the casing 4. This prevents the contact section 12 of the electrode plate 1 from being moved on the PTC thermistor 3 when the narrow section 11 is fused to separate the contact section 12 from the terminal 10, so that the contact section 12 may effectively be prevented from being electrically contacted with the fused portion of the terminal 10.

The PTC heating device of the illustrated embodiment used for an electronic mosquito destroyer is generally incorporated in an armoring case of the apparatus. In this instance, the neon lamp is set at a position of the case which is viewed from the outside.

The above description has been made in connection with the PTC heating device suitable to be incorporated in the mosquito destroyer. However, the PTC heating device of the present invention is of course widely applicable as a heating source for an electronic jar and the like.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A PTC heating device comprising:

a PTC thermistor having an upper electrode and a lower electrode on its upper and lower surface, respectively;

an upper and a lower electrode plate comprising a pair of plates between which said PTC thermistor is vertically interposed;

said upper electrode plate comprising a first substantially planar contact section in contact with said upper electrode of said PTC thermistor, a substantially inverted L-shape portion extending at one end thereof from one side of said first contact section and lying in the same plane as said first planar contact section and having as a first terminal a depending portion at an end opposite said one end of said extending portion, said inverted L-shape extending portion having a narrow section comprising an overcurrent fusion section, said lower electrode plate comprising a second contact section in engagement with said lower electrode of said PTC thermistor and having a second contact terminal depending from said second contact section;

a casing of electrically insulating material having a first recess formed at an upper surface thereof and having first and second through-holes, within which first recess, said PTC thermistor and said upper and lower electrode plates are received and through which first and second through-holes said first and second terminals of said upper and lower electrode plates, respectively, project from said porcelain casing;

an insulating plate on said upper electrode plate; and a heat radiating plate on said insulating plate for covering said casing, and cooperating means on said inverted L-shape portion of said first contact section and said casing for spacing a portion of said narrow section of said inverted L-shape portion from said insulating plate and from said first recess, within which said PTC thermistor is received.

2. A PTC heating device as defined in claim 1, wherein said cooperating means comprises (a) a concavely curved portion on said narrow section of said inverted L-shape extending portion and (b) a second recess in said casing which receives said concavely curved portion therein, whereby on fusion of said narrow section, fused metal remains in said second recess so that dispersion into said first recess, within which PTC thermistor is received, is prevented.

3. A PTC heating device as defined in claim 1, wherein said PTC thermistor and said upper and lower electrode plates are assembled in said first recess of said porcelain casing in superposed relation, said lower electrode plate being outwardly bowed for elastic support of said assembly in said first recess on mounting said heat radiating plate on said insulating plate and to said casing.

4. A PTC heating device as defined in claim 1, wherein said upper electrode plate is provided with a reinforcement means formed by embossing a pair of said first terminal.

5. A PTC heating device as defined in claim 1, wherein said upper electrode plate is provided with a horizontal member through which said first terminal and said inverted L-shape portion are connected to each other, said horizontal member being interposed between said upper surface of said porcelain casing and said insulating plate.

6. A PTC heating device as defined in claim 1, wherein said overcurrent fusion detecting circuit (7) comprises a lamp circuit.

7. A PTC heating heating device as defined in claim 2, wherein said upper electrode plate further comprises a second projecting portion which extends outwardly from a side of said first contact section opposite said one side thereof and having a downwardly bent portion at an end thereof, said casing having a third recess receiving said second projecting portion.

8. A PTC heating device as defined in claim 1, wherein said upper electrode plate further comprises a lead-out terminal depending from a side of said first contact section opposite said one side thereof, said casing further having a third through-hole, through which said lead-out terminal projects from said casing, and an overcurrent fusion detecting device connected between said lead-out terminal and said second terminal of said lower electrode plate.

9. A PTC heating device as defined in claim 1, wherein said first through-hole and said second through-hole are formed in said casing in non-aligned and offset relation relative to and on opposite sides of a transverse central line of said casing.

* * * * *